US006043431A

United States Patent [19]

Kato

[11] Patent Number: 6,043,431

[45] Date of Patent: Mar. 28, 2000

[54] BRANCHING JUNCTION BOX AND METHOD FOR ASSEMBLY THEREOF

[75] Inventor: Shinshu Kato, Yokkaichi, Japan

[73] Assignee: Sumitomo Wiring Systems, Ltd., Japan

[21] Appl. No.: 09/010,905

[22] Filed: Jan. 22, 1998

[30] Foreign Application Priority Data

Jan. 24, 1997 [JP] Japan ..... 9-011203

[51] Int. Cl.[7] ..... H01H 9/02

[52] U.S. Cl. ..... 174/54; 174/58; 174/72 C; 361/759; 220/3.3; 439/76.1

[58] Field of Search ..... 174/54, 58, 59, 174/72 C, 72 TR; 361/752, 759, 796, 802; 29/742; 439/76.1, 76.2, 949; 220/3.3, 4.02

[56] References Cited

U.S. PATENT DOCUMENTS

| | | | |
|---|---|---|---|
| 4,528,616 | 7/1985 | Koppensteiner | 361/752 |
| 4,766,520 | 8/1988 | Huber et al. | 361/813 |
| 4,881,902 | 11/1989 | Papa et al. | 439/76.1 |
| 5,091,826 | 2/1992 | Arnett et al. | 361/776 |
| 5,352,132 | 10/1994 | O'Keefe et al. . | |
| 5,425,655 | 6/1995 | Kaney . | |
| 5,435,744 | 7/1995 | Derstine et al. . | |
| 5,550,712 | 8/1996 | Crockett | 361/752 |
| 5,563,772 | 10/1996 | Nichols | 361/752 |

FOREIGN PATENT DOCUMENTS

| | | | |
|---|---|---|---|
| 348322 | 5/1991 | Japan . | |
| 733541 | 7/1995 | Japan . | |
| 2211364 | 6/1989 | United Kingdom | 174/58 |

*Primary Examiner*—Kristine Kincaid
*Assistant Examiner*—Dhiru Patel
*Attorney, Agent, or Firm*—Jordan B. Bierman; Bierman, Muserlian and Lucas

[57] ABSTRACT

A positioning cylinder to close positioning holes in both the upper and lower casings of a branching junction box so as to prevent dirt and moisture from entering. The positioning cylinder is preferably integral with the upper casing and hollow so as to allow it to fit over a positioning pin employed as a locator during the assembly of the junction box. The positioning cylinder not only closes the holes that are in the upper and lower casing of the junction box, but also stabilizes the busbar substrates that are in the junction box and provides for a more integral and secure junction.

8 Claims, 3 Drawing Sheets

BRANCHING JUNCTION BOX AND METHOD FOR ASSEMBLY THEREOF

This Application claims the benefit of the priority of Japanese 9-11203, filed Jan. 24, 1997.

The Invention relates to a branching junction box and a method for assembly thereof which is primarily intended for use in automobiles.

BACKGROUND OF THE INVENTION

Branching junction boxes are typically used in the engine compartments of automobiles in order to connect electrical components. Typically, they comprise a busbar substrate which is housed within a casing, the casing consisting of an upper case and a lower case which are joined by a gasket. Conventionally, the casing has two or more male connectors which are used in order to form the electrical connection between two components. The connectors comprise a male cavity having male tab openings therein. Tabs from the busbar substrate extend through the male tab openings and into the male connector cavity in order to provide a point of connection for the electrical components.

In the conventional assembly process of a branching junction box, the lower case is positioned with a positioning tool and a chuck portion of an automated device inserts the busbar substrate therein. Both the first and the last busbar substrates have their male tabs aligned with the male tab openings of the male connector. This can cause a problem in that the tabs do not always align and damage can occur either to the tabs or to the lower or upper case in the area of the male connector.

In order to overcome this misalignment problem, positioning pins have been employed on the positioning tool and corresponding holes have been made in the lower case and the busbar substrate. Such a solution is described in Japanese Utility Model Examined Publication Number 7-33541 (Japanese Utility Model Laid-Open Publication Number 1-146716). In this Publication, it is taught that the two positioning pins and corresponding holes are disposed at diagonal corners. It has been found that, by employing positioning pins along with their respective positioning holes, the misalignment problem and damage to both the tabs and the casing of the junction box can be significantly reduced.

Although the positioning pin and respective positioning holes solve the problem of misalignment, they result in another problem; i.e., the positioning holes allow moisture and dirt to enter the casing. Branching junction boxes are normally mounted in the engine compartment of an automobile. The engine compartment is not a closed area and dirt and water from the front tires and from the road surface often enter the engine compartment and cover the electrical components. Also, moisture from condensation forms on the top of the junction box casing. The pilot holes that are in the casing, both in the upper casing and the lower casing, provide entrances for both dirt and water into the junction box. As can be appreciated, both the dirt and water in the junction box can cause short circuiting and/or damage to the electrical circuitry therein; hence, there is a need to prevent their ingress into the electrical components of the junction box while still employing the positioning pin and positioning holes in its assembly.

SUMMARY OF THE INVENTION

Applicants have solved this problem by employing a positioning cylinder. The positioning cylinder connects the holes in both the upper and lower casing and passes through the positioning holes in the busbar substrate. It closes off the holes in both the upper and lower casings so as to prevent the entry of water and dirt into the junction box. It has also been found that the use of the positioning cylinder makes a more stable junction box in that it maintains the alignment of the busbar substrates and the upper and lower casing after assembly.

Preferably, the positioning cylinders are hollow, thereby acting as conduits for moisture and dirt to pass from the outside top cover of the junction box to the bottom of the junction box without interfering with the electrical circuitry. Additionally, by having the positioning cylinder hollow throughout, it can be mounted on the positioning pin during the assembly of the junction box. Preferably, the positioning cylinder is affixed to the bottom of the upper casing.

Broadly, the junction box and the present Invention comprises:

- a lower case and an upper case for holding a busbar substrate;
- a first positioning hole disposed in said lower case;
- a second positioning hole disposed in said busbar substrate;
- a third positioning hole disposed in said upper case; and
- a positioning cylinder which closes said first, second, and third positioning holes.

Preferably, the positioning cylinder is hollow to accommodate a positioning pin employed during assembly of the junction box. It is also preferred that the positioning cylinders of the present Invention have a length equal to the distance from the top surface of the upper casing to the bottom surface of the lower casing, when said lower casing and upper casing are joined to form the junction box. It is also preferred that the positioning cylinder is affixed to the upper casing.

The method of the present Invention for assembling the branching junction box comprises:

- inserting a positioning pin projecting from a positioning tool through a first positioning hole disposed in the lower casing;
- disposing a busbar substrate in said lower casing and inserting the positioning pin through a second positioning hole formed in the busbar substrate;
- inserting a hollow positioning cylinder over the positioning pin wherein the cylinder passes through the first positioning hole and second positioning hole; and
- placing the upper casing over the lower casing whereby the upper casing has a third positioning hole such that the third positioning hole aligns with the positioning cylinder.

A preferable method of the present Invention for assembly of the junction box comprises:

- inserting the positioning pin projecting from the positioning tool through the first positioning hole disposed in the lower casing;
- disposing the busbar substrate in the lower case, and inserting the positioning pin through the second positioning hole formed in the busbar substrate;
- placing the upper casing over the lower casing, whereby the upper casing has its hollow positioning cylinder projecting therefrom so that the positioning cylinder passes through the first and second positioning holes and over the positioning pin.

The method for assembling a junction box in accordance with the present Invention can also comprise the steps of:

inserting the positioning pin projecting from the positioning tool through the first positioning hole in the lower case;

disposing a busbar substrate in the lower case, and inserting the positioning pin through the second positioning hole formed in the busbar substrate;

placing the upper casing over the lower casing and inserting the positioning pin through the third positioning hole in the upper case;

withdrawing the positioning pin from the first, second, and third positioning holes; and inserting the positioning cylinder through said first, second and third positioning holes so that the positioning cylinder closes the first and third positioning holes.

As can be appreciated, the hollow positioning cylinder can be inserted at any time during the assembly operation. In other words, the hollow positioning cylinder can be mounted on the positioning pin prior to the lower case being positioned on the positioning pin, it can be inserted after the lower case has been inserted over the positioning pin but before the busbar substrate is inserted over the positioning pin; it can be inserted over positioning pin after the busbar substrate has been inserted in the lower casing but before the upper case has been placed over the positioning pin; or it can be inserted after the junction box has been fully completed but it has been removed from the positioning tool. Naturally, where the positioning cylinder is solid, it can only be inserted after the positioning pin has been withdrawn from the positioning holes in the various components of the junction box, unless the positioning pin and the positioning cylinder are one and the same.

Where the positioning cylinder is hollow, it can also be affixed to either the upper casing or the lower casing and, thus, is assembled and inserted over the positioning pin when that component which it is affixed to is first placed over the positioning pin.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
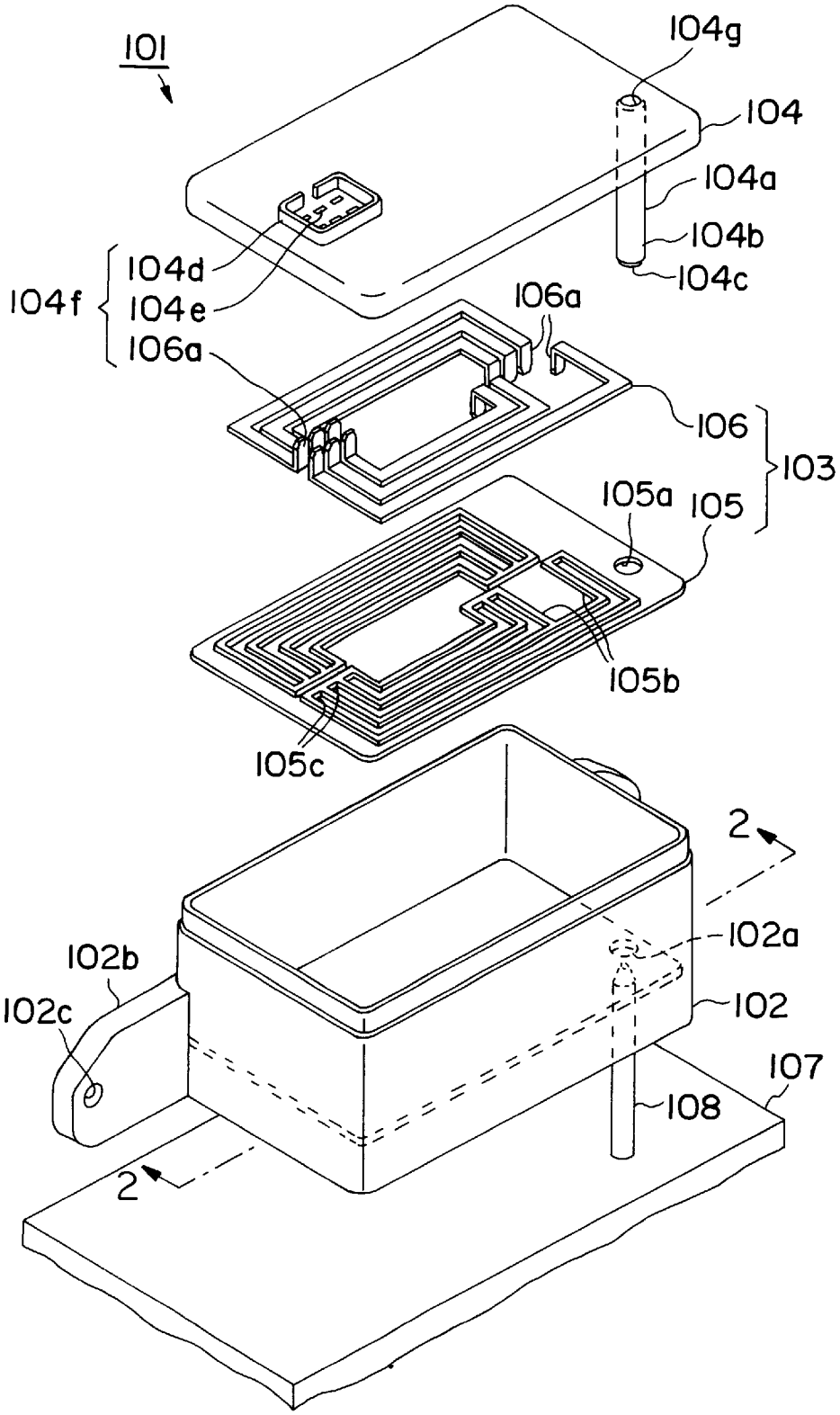
FIG. 1 illustrates an exploded perspective view of the branching junction box according to the present Invention.

Referring to FIG. 1, branching junction box 101 comprises lower case 102, busbar substrate 103, and upper case 104. Lower case 102 and upper case 104 are formed integrally from a synthetic resin. The busbar substrate 103 is held between lower case 102 and upper case 103. A gasket (not shown in the drawing) is employed at the junction of the upper and lower cases in order to prevent water from entering the junction box.

Positioning hole 102*a* is formed in lower case 102. Lower case 102 is shown having attachment plate 102*b* for attachment to the engine compartment of a vehicle. Attachment plate 102*b* has attachment hole 102*c* formed therein.

Busbar substrate 103 comprises insulating substrate 105 and busbar 106. Positioning hole 105*a* is formed in insulating substrate 105 at a position corresponding to first positioning hole 102*a* in lower casing 102. Insulating ribs 105*b* are formed on insulating substrate 105 at positions corresponding to busbar 106 so as to insulate the busbars and maintain a distance between them. Tabs 106*a* are formed at prescribed positions one busbar 106 and are is inserted through tab openings 105*c* of insulating substrate 105.

Positioning cylinder 104*a* is preferably formed as a projection from upper case 104 to be inserted through positioning holes 102*a* and 105*a*. End 104*b* of positioning cylinder 104*a* is beveled on its outer perimeter. This beveling forms sloping surface 104*c* which is sloped toward the outside of positioning cylinder 104*a*. When upper casing 104 is mounted on lower casing 102, the length of positioning cylinder 104*a* is set so that it projects past the bottom surface of lower casing 102. Hole 104*g* is formed in positioning cylinder 104*a* and is open to the upper surface of upper casing 104.

A male connector cavity 104*d* is on the upper surface of upper casing 104 and contains male tab opening 104*e*. Tabs 106*a* of busbar 106 are inserted through male tab openings 104*e* from the opposite side of the male connector cavity 104*d*, and tabs 106*a* project into male connector cavity 104*d*, thus forming male connector 104*f*. Male connector 104*f* comprises male connector cavity 104*d*, male tab opening 104*e*, and tabs 106*a*.

Figure 2:
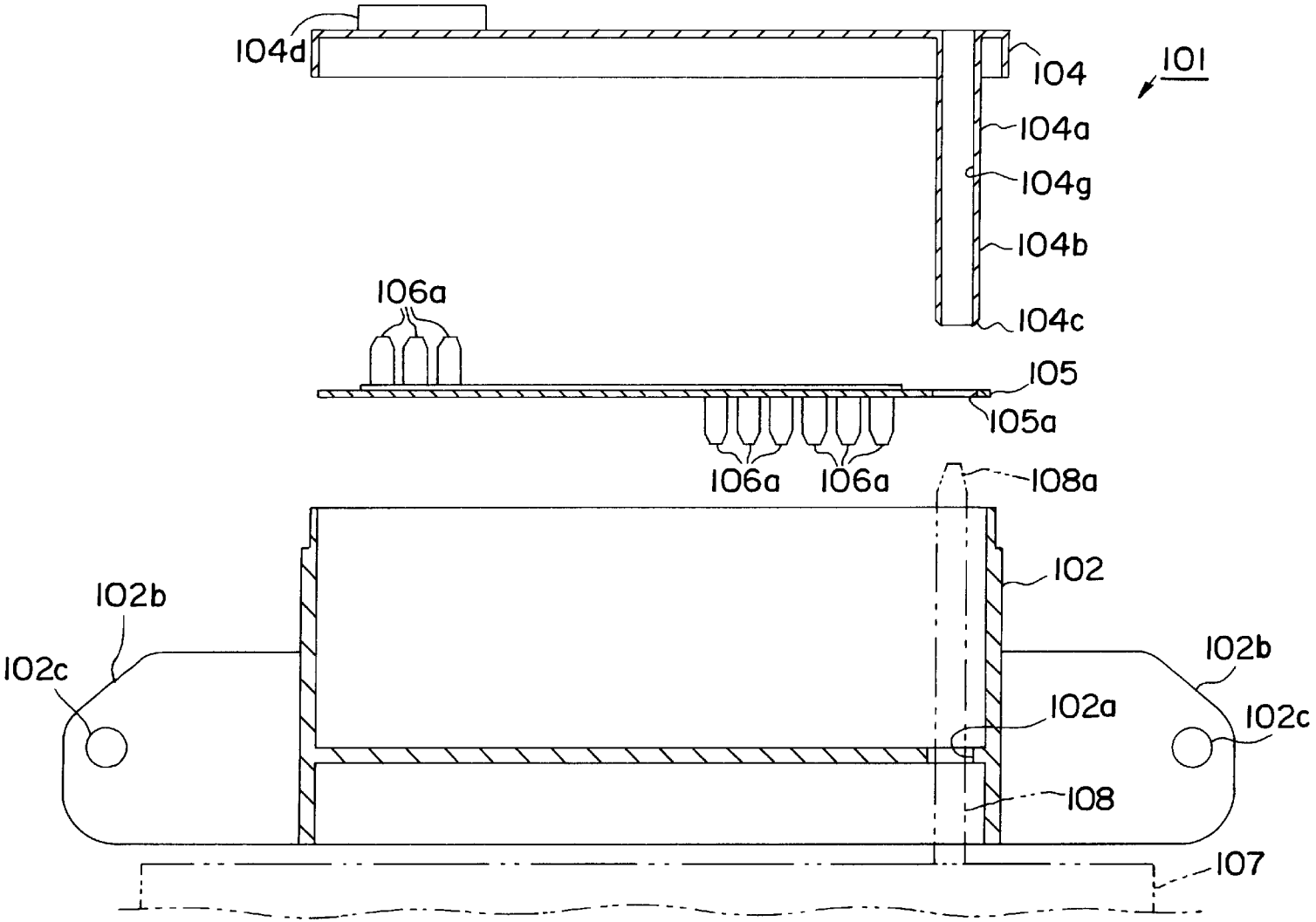
FIG. 2 is a cross section along line A—A of FIG. 1.

The preferred assembly operation for making the branch junction box in accordance with the present Invention will now be described with particular reference to FIGS. 2 and 3. Positioning tool 107 is used to assemble branching junction box 101. Positioning pin 108 is projected from positioning tool 107. End 108*a* of positioning pin 108 is tapered as shown in the Figures.

First, lower case 102 is grasped by a chuck (not shown in the drawing) of an automated device. Positioning hole 102*a* of lower case 102 is passed over positioning pin 108. Since end 108*a* of positioning pin 108 is tapered, positioning pin 108 is easily inserted through positioning hole 102*a*. As a result, lower case 102 is positioned relative to positioning tool 107.

Next, busbar substrate 103 is grasped using the chuck of the automated device, and positioning hole 105*a* of busbar substrate 103 is aligned with and mounted on positioning pin 108. Here, too, since end 108*a* is tapered, positioning pin 108 is easily inserted through positioning hole 105*a*. Since positioning pin 108 is inserted through positioning hole 105*a*, busbar substrate 103 is reliably assembled and located in lower case 102.

Next, upper case 104 is grasped with the chuck of the automated device. Positioning pin 108 is inserted through hole 104*g* of positioning cylinder 104*a* mounted on upper case 104. Positioning cylinder 104*a* is inserted through positioning hole 102*a* of lower case 102 and positioning hole 105*a* of busbar substrate 103. End 104*b* of positioning cylinder 104*a* projects past the bottom surface of lower case 102. Sloped surface 104*c* is formed on end 104*b* of positioning cylinder 104*a* so as to allow end 104*b* to be smoothly guided into and through positioning holes 102*a* and 105*a*. Thus, even if there is a slight misalignment of positioning cylinder 104*a* relative to positioning holes 102*a* and 105*a*, it can be reliably fitted into and through the positioning holes. Also, since end 108*a* of positioning pin 108 is tapered, positioning pin 108 can be easily inserted through hole 104*g*.

As a result of this assembly, tabs 106*a* and male tab opening 104*e* are positioned by positioning pin 108 and positioning cylinder 104*a*. Thus, tabs 106*a* can reliably be inserted into male tab openings 104*e*. Thus, if a force is applied to tab 106*a* when it is in contact with upper case 104, tab 106*a* will not be deformed because it is properly aligned with male tab opening 104*e*.

Figure 3:
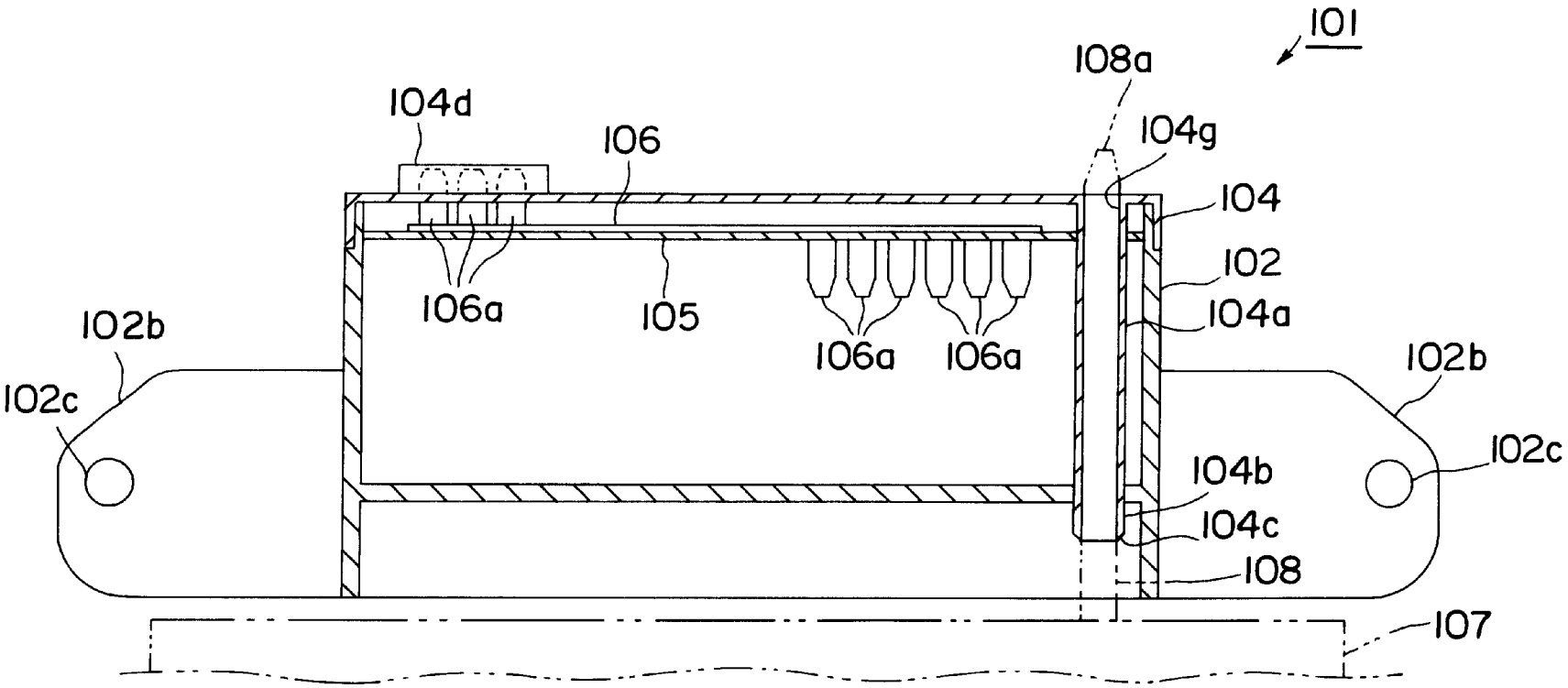
FIG. 3 is a cross section of an assembled junction box according to the present Invention.

Referring to FIG. 3, lower case 102, busbar substrate 103, and upper case 104 are reliably and accurately located by positioning pin 108. The length of positioning pin 108 is set so that it projects past the upper surface of upper casing 104 when lower casing 102 and upper casing 104 are assembled.

As can be appreciated from the foregoing description, the positioning of busbar substrate 103 between lower case 102 and upper case 104 is accomplished reliably and damage to tabs 106*a* and male tab openings 104*e* is prevented. It will also be appreciated that positioning cylinder 104*a* closes off the positioning holes in both lower case 102 and upper case 104, thereby preventing dirt and moisture from entering branch junction box 101. In a preferred form of the Invention, reinforcing ribs can be disposed around positioning holes 102*a,* 105*a,* and 104*g* in order to prevent possible damage from either positioning cylinder 104*a* or from positioning pin 108 during assembly. The present Invention can also be employed without the need for positioning tool 107 and respective positioning pin 108. In other words, employing and positioning cylinder 104*a* can be done with or without the automated device.

Although the Application has been described only with reference to a busbar substrate, it will be appreciated by those skilled in the art that multiple busbar substrates can be employed in the junction box in accordance with the present Invention. Obviously, where multiple busbar substrates are present each of the busbar substrates has at least one positioning hole which corresponds to positioning pin 108. Although one single set of holes and one positioning cylinder for each busbar substrate have been taught, two or more sets and cylinders may be used for additional positive location as desired.

While only a limited number of specific embodiments of the present Invention have been expressly disclosed, it is, nonetheless, to be broadly construed, and not to be limited except by the character of the clams appended hereto.

I claim:

1. A branching junction box comprising:

a lower case and an upper case with a busbar substrate therein;

a first positioning hole disposed in said lower case;

a second positioning hole disposed in said busbar substrate;

a third positioning hole in said upper case; and a positioning hollow cylinder which is in said first, second and third positioning holes, closes said first and third positioning holes, and permits contaminants to drain therethrough without entering said junction box.

2. The branching junction box of claim 1 wherein:

said positioning cylinder is adapted to accommodate a positioning pin during assembly of said branching junction box.

3. The branching junction box of claim 2 wherein:

said positioning cylinder has a length at least equal to a distance from a bottom surface of said lower case to a top of said upper case, when said lower case and upper case are joined to form said junction box.

4. The branching junction box of claim 1 wherein said positioning cylinder is affixed to said upper case.

5. The branching junction box of claim 1 wherein said positioning cylinder tapers in a direction in which said positioning cylinder is inserted.

6. A method for assembling a branching junction box including an upper case and a lower case, said method comprising:

(a) inserting a positioning pin through a first positioning hole on said lower case;

(b) disposing a busbar substrate in said lower case, so that said positioning pin passes through a second positioning hole formed in said busbar substrate;

(c) disposing said upper case over said lower case, and inserting said positioning pin through a third positioning hole formed in said upper case;

(d) removing said positioning pin from said first, second, and third positioning holes; and (e) inserting a positioning cylinder into said first, second and third positioning holes to close said first and third positioning holes.

7. A method for assembling a branching junction box including an upper case and a lower case, said method comprising:

(a) inserting a positioning pin through a first positioning hole in said lower case;

(b) disposing a busbar substrate in said lower case so that said positioning pin passes through a second positioning hole in said busbar substrate;

(c) placing said upper casing over said lower casing, wherein said upper casing has a positioning cylinder projecting from said upper case, passing said positioning cylinder through said first and said second positioning holes and over said positioning pin, and (d) withdrawing said positioning pin from within said positioning cylinder.

8. A method for assembling a branching junction box including an upper case and a lower case, said method comprising:

(a) inserting a positioning pin through a first positioning hole in said lower case;

(b) disposing a busbar substrate in said lower case, so that said positioning pin passes through a second positioning hole in said busbar substrate;

(c) inserting a positioning cylinder over said positioning pin and through said first and said second positioning holes;

(d) disposing said upper casing over said lower casing and inserting said positioning pin and said positioning cylinder through a third positioning hole formed in said upper casing, and (e) withdrawing said positioning pin from within said positioning cylinder.

* * * * *